US005502971A

United States Patent [19]

McCarthy et al.

[11] Patent Number: 5,502,971

[45] Date of Patent: Apr. 2, 1996

[54] LOW PRESSURE RECOVERY OF OLEFINS FROM REFINERY OFFGASES

[75] Inventors: Frank D. McCarthy, Wayne; Stephen J. Stanley, Matawan, both of N.J.; David M. Wadsworth, Laconia, N.H.

[73] Assignee: ABB Lummus Crest Inc., Bloomfield, N.J.

[21] Appl. No.: 370,005

[22] Filed: Jan. 9, 1995

[51] Int. Cl.[6] ..... F25J 3/00

[52] U.S. Cl. ..... 62/20; 62/40; 585/867

[58] Field of Search ..... 62/20, 40; 585/867

[56] References Cited

U.S. PATENT DOCUMENTS

| | | | |
|---|---|---|---|
| 2,321,666 | 6/1943 | Felbeck | 62/175.5 |
| 2,887,850 | 5/1959 | Adams | 62/17 |
| 2,956,410 | 10/1960 | Palazzo et al. | 62/13 |
| 3,520,143 | 7/1970 | Becker | 62/28 |
| 3,633,371 | 1/1972 | Davison | 62/17 |
| 4,157,905 | 6/1979 | Hengstebeck | 62/34 |
| 4,270,940 | 6/1981 | Rowles et al. | 62/28 |
| 4,428,759 | 1/1984 | Ryan et al. | 62/20 |
| 4,451,274 | 5/1984 | Obrien | 62/20 |
| 4,540,422 | 9/1985 | Hampton | 585/867 |
| 4,695,672 | 9/1987 | Bunting | 585/867 |
| 4,705,549 | 11/1987 | Sapper | 62/30 |
| 4,881,960 | 11/1989 | Ranke et al. | 62/20 |
| 4,883,515 | 11/1989 | Mehra et al. | 62/20 |
| 4,900,347 | 2/1990 | McCue, Jr. et al. | 62/24 |
| 5,220,097 | 6/1993 | Lam et al. | 585/809 |

*Primary Examiner*—Ronald C. Capossela
*Attorney, Agent, or Firm*—Chilton, Alix & Van Kirk

[57] ABSTRACT

A low pressure cryogenic process is disclosed for recovering $C_2$ and heavier hydrocarbons and particularly olefins from a refinery offgas containing hydrogen, methane, nitrogen oxide in addition to the $C_2$ and heavier hydrocarbons. The conventional high pressures are eliminated and the temperatures are maintained higher than the temperature at which nitrated gums can form while still maintaining high olefin recovery. The feed is deethanized or depropanized to remove the $C_4$ and heavier hydrocarbons at a temperature above the nitrated gum formation temperature. The overhead is then demethanized in a column using an enriching zone above the rectifying zone with a feed of $C_2$ or heavier paraffins between these two zones.

6 Claims, 1 Drawing Sheet

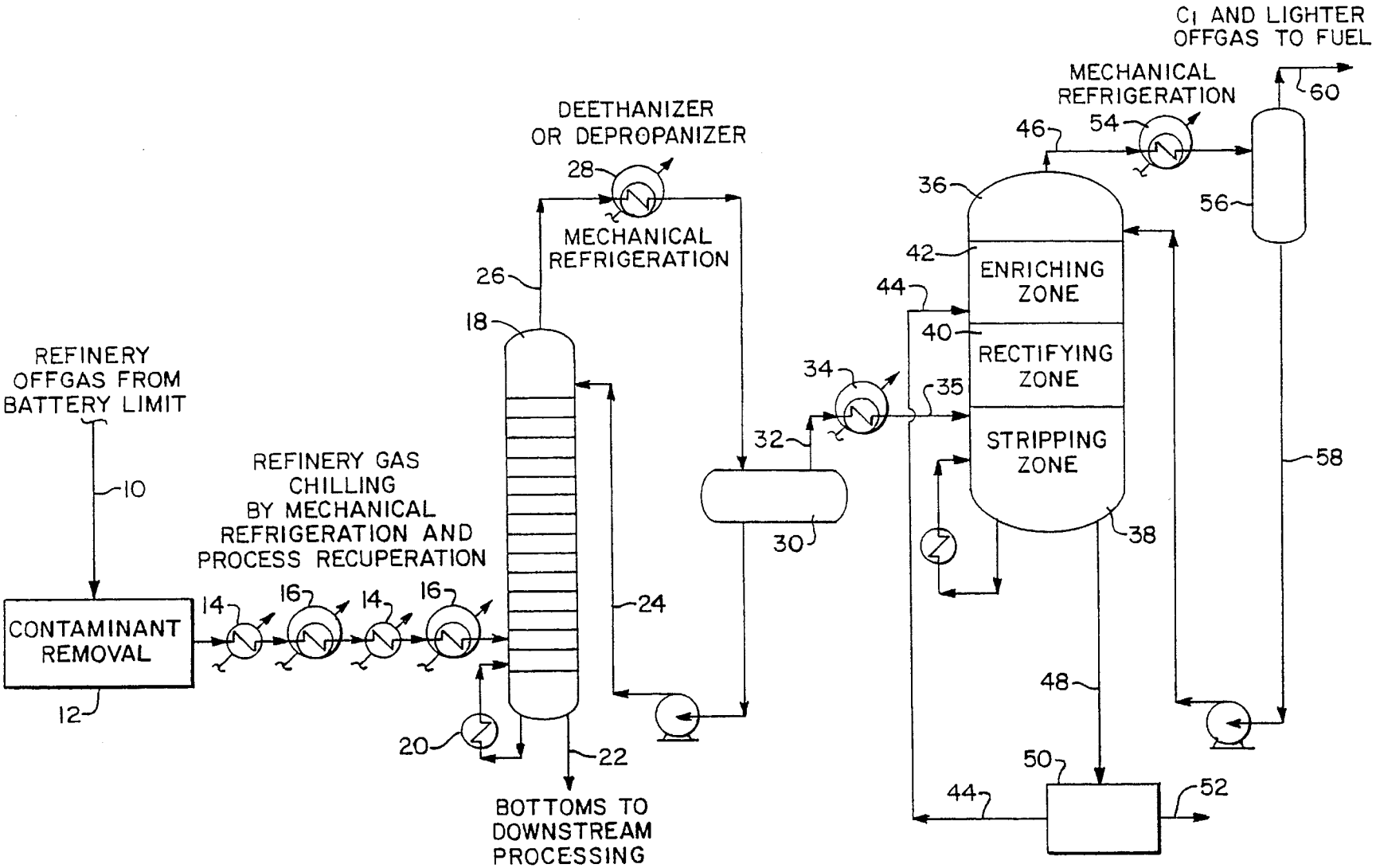
C1 AND LIGHTER OFFGAS TO FUEL
60
58
56
MECHANICAL REFRIGERATION
54
46
ENRICHING ZONE
RECTIFYING ZONE
STRIPPING ZONE
38
48
52
50
36
42
40
35
44
44
34
32
30
DEETHANIZER OR DEPROPANIZER
28
MECHANICAL REFRIGERATION
24
22
BOTTOMS TO DOWNSTREAM PROCESSING
26
18
20
16
14
16
14
REFINERY GAS CHILLING BY MECHANICAL REFRIGERATION AND PROCESS RECUPERATION
REFINERY OFFGAS FROM BATTERY LIMIT
10
CONTAMINANT REMOVAL
12

LOW PRESSURE RECOVERY OF OLEFINS FROM REFINERY OFFGASES

BACKGROUND OF THE INVENTION

Refinery offgases, typically offgases from fluid catalytic cracker units and coker units, contain quantities of olefins which can be economically recovered. Many times this recovery is integrated with existing olefins plants but in certain instances where offgas flow rates are large enough, stand-alone units have also been operated. Because of the higher quantity of lighter components such as hydrogen, nitrogen and methane, the feed gases are typically compressed from pressure of about 1.17 to 1.38 MPa gauge (170 to 200 psig) to pressures around 3.45 MPa gauge (500 psig) in multi-stage feed gas compressors. The compression step allows for the recovery of 90% to 99% of the ethylene and heavier materials contained in the feed gases using a combination of mechanical refrigeration and expansion of the methane and lighter portions of the feed gas after demethanization. However, the capital and operating costs for the feed gas compressors are very high.

The processing of refinery offgases for olefin recovery has associated safety concerns since nitrogen oxide is also present in trace amounts in the refinery offgas stream. The nitrogen oxide easily oxidizes forming nitrogen dioxide which can form solid nitrogen peroxide ($N_2O_4$) at temperatures below −102° C. $N_2O_4$ and heavier diolefins ($C_4$ +) can react at these low temperatures forming nitrated gums which are unstable and can explode if thermally or mechanically shocked.

SUMMARY OF THE INVENTION

A new, low pressure cryogenic technique has been formed for recovering $C_2$ and heavier hydrocarbons, particularly olefins, from a refinery offgas feed containing hydrogen, nitrogen oxide and methane in addition to the $C_2$ and heavier hydrocarbons. Specifically, the process eliminates the feed gas compression and high pressures while maintaining a high recovery of $C_2$ and heavier hydrocarbons at temperatures above the temperatures at which nitrated gums can form. The low pressure feed is first chilled and deethanized or depropanized to remove heavier ($C_4$+) hydrocarbons and specifically the $C_4$+ diolefins at a temperature above the nitrated gum formation temperature so that such gums will not be formed. The overhead is then demethanized in a tower by a technique using an enriching zone above a rectifying zone with a $C_2$ or heavier paraffins feed between these zones to increase the $C_2$ and heavier paraffin content of the overhead while maintaining a high bottoms recovery of the $C_2$ and heavier olefins.

BRIEF DESCRIPTION OF THE DRAWING

The drawing is a flow diagram of the present invention.

DETAILED DESCRIPTION OF THE PREFERRED EMBODIMENT

Referring to the drawing, a refinery offgas feed 10 is first treated at 12 to remove trace impurities including but not limited to arsenic, mercury, $CO_2$, $H_2O$ and acetylene. The gas feed at a pressure of 6.89 to 13.79 bars and preferably at 10.34 bars gauge is fed through a series of chilling units which may comprise a combination of process recuperation chillers 14 and mechanical refrigeration units 16 to partially condense the feed gas stream. The chilled feed gas stream is then fed to the fractionation tower 18 which includes a reboiler 20 and which is either operated as a deethanizer or a depropanizer, depending upon the feed composition and desired products. If operated as a deethanizer, the temperature of the feed gas to the deethanizer will be in the range of −25° to −60° C. and preferably −45° C., such that most of the $C_3$ and essentially all of the heavier materials will be removed as bottoms 22. If the tower is operated as a depropanizer, the feed gas temperature will be in the range of −20° to −50° C. and preferably −35° C. with most of the $C_4$ and essentially all of the heavier materials removed as bottoms 22. Fed into the top of the fractionator 18 is a reflux stream 24 as explained hereinafter. Through the use of this fractionator, whether it is operated as a deethanizer or depropanizer, the heavier diolefins ($C_4$+) are removed as bottoms from the processing sequence at temperatures well above the −102° C. where solid nitrogen peroxide would be formed. This prevents the formation of dangerously unstable $NO_x$ gums downstream during normal operation and under any reasonable levels of plant upset.

The fractionation tower overhead 26 is further chilled at 28 preferably by mechanical refrigeration and fed to reflux drum 30. If the fractionator is operating as a deethanizer, the temperature in the reflux drum will be in the range of −40° to −80° C. and preferably −65° C. whereas the range would be −20° to −60° C. and preferably −45° C. if operating as a depropanizer. In either case, a portion of the overhead 26 is condensed and separated in the reflux drum 30 as reflux 24. In the deethanizer mode, the reflux stream 24 will be primarily $C_3$ and heavier whereas it will be primarily $C_4$ and heavier in the depropanizer mode.

The overhead 32 from the reflux drum 30 containing the hydrogen, methane, $C_2$ and potentially some or all of the $C_3$ materials is further chilled at 34 down to a temperature of −75° to −100° C. and fed to the demethanizer fractionation tower 36. This fractionation tower is operated in the pressure range of 3.45 to 8.27 bars and preferably at 6.89 bars gauge. This is a much lower pressure than conventional demethanizer towers which would normally experience unacceptably low olefins recovery at such a pressure.

In order to maintain a high recovery of olefins, the demethanizer tower 36 includes three zones; a bottom stripping zone 38 below the feed stream 35, a middle rectifying zone 40 above the feed stream 35 and a top enriching zone 42. A chilled $C_2$ or heavier paraffin stream 44 is fed into the demethanizer between the enriching zone 42 and the rectifying zone 40. This stream 44 is at a temperature of −80° to −100° C. and preferably −99° C. The function is to increase the $C_2$ and heavier paraffin content of the demethanizer overhead 46 and sufficient contacting area is provided in the enriching zone to accomplish this function. The $C_2$ and heavier paraffin is lean with respect to olefins. Therefore, by equilibrium, some olefins condense and some paraffins vaporize so there is a net reduction in olefins leaving in the overhead and a net increase in paraffins in the overhead. The quantity of enriching liquid required is a function of the feed gas and enriching liquid composition as well as the desired olefin losses in the net overhead stream. The recovery of $C_2$ and heavier olefins in the demethanizer bottoms is maintained at a high rate of 95% to 99%. The enriching of the demethanizer overhead with $C_2$ and heavier paraffins decreases the loss of olefins below the level which could be achieved at these low pressures by the use of mechanical refrigeration thereby eliminating the need for either feed gas compression or demethanizer overhead expansion. The use of $C_2$ or heavier paraffins as the enriching liquid is ideal since these are contained in the feed gas and must be separated from the olefins and are usually used as fuel along with the demethanizer overhead. As depicted in the drawing, the bottoms 48 from the demethanizer 36 is fed to the downstream portion of the olefins plant generally designated as 50, in which olefins 52 are separated from paraffins 44 and in which certain hydrogenations are usually carried out. It is these separated paraffins 44 that are fed to the enriching zone.

The overhead 46 from the demethanizer 36 is cooled at 54 down to a temperature range of −80° to −100° C. and preferably to −99° C. At least a portion of the $C_2$ and heavier components are condensed and separated in the reflux drum 56. The liquid 58 is fed to the top of the demethanizer as reflux. The offgas 60 contains all of the hydrogen, essentially all of the methane and very little $C_2$ or heavier components. This offgas is usually used as fuel.

As can be seen, the coldest temperature reached in the process of the present invention where $NO_x$ and $C_4$+ diolefins are both present is −40° to −80° C. Therefore, even though the system is operating at a low pressure, the temperature does not need to be below the freezing point of nitrogen peroxide thereby essentially eliminating the risk of $NO_x$ gum formation and accumulation in the system.

We claim:

1. A method of recovering olefins from refinery offgases containing hydrogen, methane, $C_2$, $C_3$, $C_4$ and heavier components including paraffins, olefins and diolefins and nitrogen oxide, using a relatively low pressure comprising the steps of:

a) providing a feedstream of said refinery offgases at a pressure of 6.89 to 13.79 bars;

b) cooling said feedstream to a temperature in the range of −20° to −60° C.;

c) fractionating said cooled feedstream to produce an overhead containing at least essentially all of said hydrogen, methane and $C_2$ components and a bottoms containing at least essentially all of said $C_4$ and heavier components;

d) cooling said overhead to a temperature in the range of −20° to −80° C. to produce a condensed fractionator recycle containing at least essentially all of said $C_4$ and heavier components and a vapor stream containing at least essentially all of said hydrogen, methane and $C_2$ components;

e) further cooling said vapor stream to a temperature in the range of −75° to −100° C. and feeding said further cooled vapor stream into a demethanizer column containing a lower stripping zone, a central rectifying zone and an upper enriching zone at a location between said stripping and rectifying zones and at a pressure of 3.45 to 8.27 bars;

f) feeding a stream of $C_2$ or heavier paraffins at a temperature in the range of −80° to −100° C. into said demethanizer column between said rectifying and enriching zones to increase the paraffin content and reduce the olefin content of the demethanizer overhead;

g) cooling said demethanizer overhead and separating a condensed demethanizer reflux and an overhead vapor product containing essentially only hydrogen and methane; and h) removing a demethanizer column bottoms containing essentially all of said $C_2$ and heavier components.

2. A method as recited in claim 1 wherein said feedstream is cooled to −25° to −60° C. and said fractionating step (c) produces a bottoms further containing most of said $C_3$ components.

3. A method as recited in claim 2 wherein said step (d) of cooling said overhead comprises cooling to a temperature range of −40° to −80° C. thereby producing a condensed fractionation recycle also containing most of said $C_3$ components.

4. A method as recited in claim 1 wherein said feedstream is cooled to −20° to −50° C. and said step (d) of cooling said overhead comprises cooling to a temperature range of −20° to −60° C. thereby producing a vapor stream also containing most of said $C_3$ components.

5. A method as recited in claim 1 wherein said demethanizer column bottoms is processed to recover olefins and a stream of $C_2$ or heavier paraffins and feeding said stream of $C_2$ or heavier paraffins to step (f) as feed to said demethanizer column.

6. A method of recovering olefins from refinery offgases containing hydrogen, methane, $C_2$, $C_3$ and $C_4$ and heavier components including olefins and paraffins and nitrogen oxide using a relatively low pressure and without forming solid nitrogen peroxide comprising the steps of:

a) providing a feedstream of said refinery offgases at a pressure of 6.89 to 13.79 bars;

b) cooling and fractionating said feedstream at a temperature not lower than −60° C. to produce an overhead containing at least essentially all of said hydrogen, methane and $C_2$ components and a bottoms containing at least essentially all of said $C_4$ and heavier components;

c) cooling said overhead not lower than −80° C. to produce a condensed fractionator recycle containing at least essentially all of said $C_4$ and heavier components and a vapor stream containing at least essentially all of said hydrogen, methane and $C_2$ components;

d) further cooling said vapor stream to a temperature below −75° C. and feeding said further cooled stream into a demethanizer containing a lower stripping zone, a middle rectifying zone and an upper enriching zone at a location between said stripping and rectifying zones and at a pressure of 3.45 to 8.27 bars;

e) feeding $C_2$ or heavier paraffins at a temperature of −80° to −100° C. into said demethanizer column between said rectifying and enriching zones to increase the paraffin content and reduce the olefin content of the demethanizer overhead;

f) cooling said demethanizer overhead and separating a condensed demethanizer reflux and an overhead vapor product containing essentially only hydrogen and methane; and g) removing a demethanizer column bottoms containing essentially all of the remaining $C_2$ and heavier components.

* * * * *